US012538990B1

(12) United States Patent
Garand

(10) Patent No.: US 12,538,990 B1
(45) Date of Patent: Feb. 3, 2026

(54) TUBULAR COMPONENT HAVING FACE-TO-FACE INTERNAL POCKETS FOR SECURING AN OBJECT THEREBETWEEN

(71) Applicant: Peter Bradley Garand, Kannapolis, NC (US)

(72) Inventor: Peter Bradley Garand, Kannapolis, NC (US)

( * ) Notice: Subject to any disclaimer, the term of this patent is extended or adjusted under 35 U.S.C. 154(b) by 0 days.

(21) Appl. No.: 19/233,362

(22) Filed: Jun. 10, 2025

(51) Int. Cl.
*A47G 9/02* (2006.01)

(52) U.S. Cl.
CPC ..... *A47G 9/0253* (2013.01)

(58) Field of Classification Search
CPC ..... A47G 9/0253; A47G 9/0238
See application file for complete search history.

(56) References Cited

U.S. PATENT DOCUMENTS

| | | | | | |
|---|---|---|---|---|---|
| 823,930 | A | | 6/1906 | Coakley | |
| 2,217,999 | A | | 10/1940 | De Woskin | |
| 2,446,396 | A | | 8/1948 | Waranch | |
| 2,637,861 | A | * | 5/1953 | Kethledge | A47G 9/0253 5/490 |
| 2,692,396 | A | | 10/1954 | Cheesman | |
| 2,759,200 | A | * | 8/1956 | Johnston | A47G 9/0253 5/490 |
| 2,779,033 | A | * | 1/1957 | Fountain | A47G 9/0253 5/490 |
| 4,144,603 | A | | 3/1979 | Schaechter | |
| 4,864,656 | A | * | 9/1989 | Nesse | A41D 27/04 441/106 |
| 4,944,604 | A | * | 7/1990 | Myklebust | B65D 88/1681 383/7 |
| 4,999,848 | A | * | 3/1991 | Oney | A41D 1/04 40/586 |
| 5,133,344 | A | * | 7/1992 | Jurrius | A62B 17/04 128/201.29 |
| 6,041,458 | A | * | 3/2000 | Vickers | A47G 9/10 5/636 |
| 6,971,128 | B1 | | 12/2005 | McGrath | |
| 7,661,152 | B2 | * | 2/2010 | Manzano-Rivera | A61M 25/02 2/338 |
| 8,448,610 | B1 | * | 5/2013 | Zeitler | A61D 9/00 119/856 |
| 8,464,376 | B1 | | 6/2013 | Waite | |
| 8,950,025 | B2 | * | 2/2015 | Kaminski, Jr. | A47C 20/021 5/492 |

(Continued)

FOREIGN PATENT DOCUMENTS

| | | | | |
|---|---|---|---|---|
| CN | 119908573 A | * | 5/2025 | A47G 9/0261 |
| WO | WO-9913749 A1 | * | 3/1999 | A47G 9/1027 |

(Continued)

*Primary Examiner* — David E Sosnowski
(74) *Attorney, Agent, or Firm* — Dunlap Bennett & Ludwig PLLC

(57) ABSTRACT

A tubular component adapted to receive and secure an object within the lumen of the tubular component, where the object is secured inward of the opposing open ends of the tubular component. For each open end, a pocket component internal to the tubular component is provided where an opening of each pocket component faces toward a midpoint of the tubular component to define face-to-fac e pocket arrangement of the pockets, wherein this face-to-face pocket arrangement secures the object wholly between the respective pocket components.

8 Claims, 3 Drawing Sheets

(56) References Cited

U.S. PATENT DOCUMENTS

| | | | | |
|---|---|---|---|---|
| D750,919 | S | 3/2016 | Patenaude | |
| 10,582,783 | B1 | 3/2020 | Hill | |
| 10,799,045 | B2 | 10/2020 | Alletto, Jr. | |
| 10,898,007 | B1 * | 1/2021 | Rozon | A47C 20/025 |
| 11,116,337 | B2 | 9/2021 | Alletto, Jr. | |
| 11,272,797 | B1 * | 3/2022 | Ganushchak | A47G 9/0253 |
| 2004/0006815 | A1 * | 1/2004 | Carroll | A62B 17/006 2/457 |
| 2004/0187210 | A1 * | 9/2004 | Hickman | A47G 9/0253 5/482 |
| 2007/0245493 | A1 * | 10/2007 | Leifermann | A47G 9/0253 5/636 |
| 2015/0173535 | A1 * | 6/2015 | Reese | A47G 9/0253 5/490 |
| 2016/0007775 | A1 | 1/2016 | Lusk | |
| 2016/0067635 | A1 * | 3/2016 | Geyer | B01D 29/232 210/337 |
| 2016/0135623 | A1 | 5/2016 | Montzka | |
| 2021/0235781 | A1 * | 8/2021 | Carlson | A41D 1/08 |
| 2021/0386222 | A1 | 12/2021 | O'Veal | |
| 2022/0031099 | A1 * | 2/2022 | Cordani | A47G 9/0253 |
| 2022/0369730 | A1 * | 11/2022 | Gray | A41D 27/10 |
| 2024/0260700 | A1 * | 8/2024 | Jensen | A42B 7/00 |
| 2024/0324798 | A1 | 10/2024 | Krishnaratne | |
| 2024/0358103 | A1 * | 10/2024 | Mazzarolo | A41D 3/00 |
| 2024/0366000 | A1 | 11/2024 | McClard | |
| 2025/0134282 | A1 * | 5/2025 | Luttrell | A47G 9/0261 |

FOREIGN PATENT DOCUMENTS

| | | | | |
|---|---|---|---|---|
| WO | WO-2008020319 | A2 * | 2/2008 | A47G 9/10 |
| WO | WO-2008038156 | A2 * | 4/2008 | A47G 9/1081 |

* cited by examiner

TUBULAR COMPONENT HAVING FACE-TO-FACE INTERNAL POCKETS FOR SECURING AN OBJECT THEREBETWEEN

BACKGROUND OF THE SUBJECT DISCLOSURE

The present subject disclosure relates to retaining elements and, more particularly, to a tubular component having face-to-face internal pockets for securing an object therebetween.

People use pillowcases or shams to cover pillows to protect the pillow from becoming soiled by use. In essence, the typical removable (washable) pillowcase is a pouch closed on all sides but for a slit or open end through which the pillow is placed. In certain versions, the open end is sealable by way of a zipper or other detachable fastener types.

Unfortunately, these removable pillowcases frequently allow the enveloped pillow to move around, since these removable pillowcases cannot be tailored to perfectly fit all the many different pillow sizes and types. This unintentional movement of the pillow during a night's sleep can cause the user to partially or fully wake up to readjust the pillow to their liking.

Notwithstanding the instances where the removable pillowcase is tailored for a specific size and type of pillow, without fasteners along the open end of that pillowcase the initially enclosed pillow could still protrude from the open end. Solving this problem by having open-end fasteners introduces other disadvantages, namely open-end fasteners can take time (especially button type fasteners) to open and close and be alarmingly uncomfortable when contacted during use.

The inventor first tinkered with having an internal pouch within the pillowcase but found a mere pouch-within-a-pouch configuration allowed the pillow to migrate out of the internal pouch.

As can be seen, there is a need for a tubular component having face-to-face internal pockets for securing an object therebetween for use as a pillowcase or for other instances where a user wants an object to be secured between two open ends of a tubular material.

SUMMARY OF THE SUBJECT DISCLOSURE

The subject disclosure provides a tubular component having face-to-face internal pockets for securing an object therebetween, thereby enabling better night sleep for those using the subject disclosure as a pillowcase as it prevents the enclosed pillow from moving around.

The subject disclosure provides two spaced-apart, face-to-face internal pockets (colloquially known as 'double inside kangaroo pouches') wherein an object secured and bookended by the two internal pockets are prevented from moving to a far greater degree than the prior art.

The subject disclosure enables a pillowcase that is open on both opposing ends, allowing two access points for installing and uninstalling a pillow as well as affording a 'flat end' look on both ends (as opposed to only the end that receives the pillow in prior art pillowcases).

In one aspect of the subject disclosure, a tubular component is provided to receive and secure an object within a lumen of the tubular component inward of the opposing open ends thereof. The tubular component has a hollow extending to opposing first and second open ends. For each open end, a pocket component internal to the tubular component is provided where each pocket component is inward of and spaced apart from the open end, and where an opening of the pocket component faces toward a midpoint of the tubular component so as to define a face-to-face pocket arrangement of the opposing pocket components adapted to secure an object wholly between the respective pocket components.

In another aspect of the subject disclosure, the tubular component further provides wherein each pocket component includes an attached portion and an unattached portion, wherein the attached portion is attached to an inner surface of the tubular component while the unattached portion is not attached to the inner surface of the tubular component, wherein each attached portion is attached to a shared side of the inner surface of the tubular component, wherein each attached portion defines a boundary that the respective end of the object can occupy during a used condition, wherein the tubular component is made of material sufficiently pliable to move between the used condition and a flat condition in absence of the object, wherein the tubular component is a pillowcase and the object is a pillow, wherein for each open end, an offset distance between the open end and an entirety of the attached portion may be between two and six inches, wherein a length each unattached portion may extend from a respective attached portion and said midpoint of the tubular component is between eight and ten inches, wherein the tubular component is made of material sufficiently pliable to move between the used condition and a flat condition in absence of the object.

These and other features, aspects and advantages of the present subject disclosure will become better understood with reference to the following drawings, description and claims.

DETAILED DESCRIPTION OF THE SUBJECT DISCLOSURE

Figure 1:
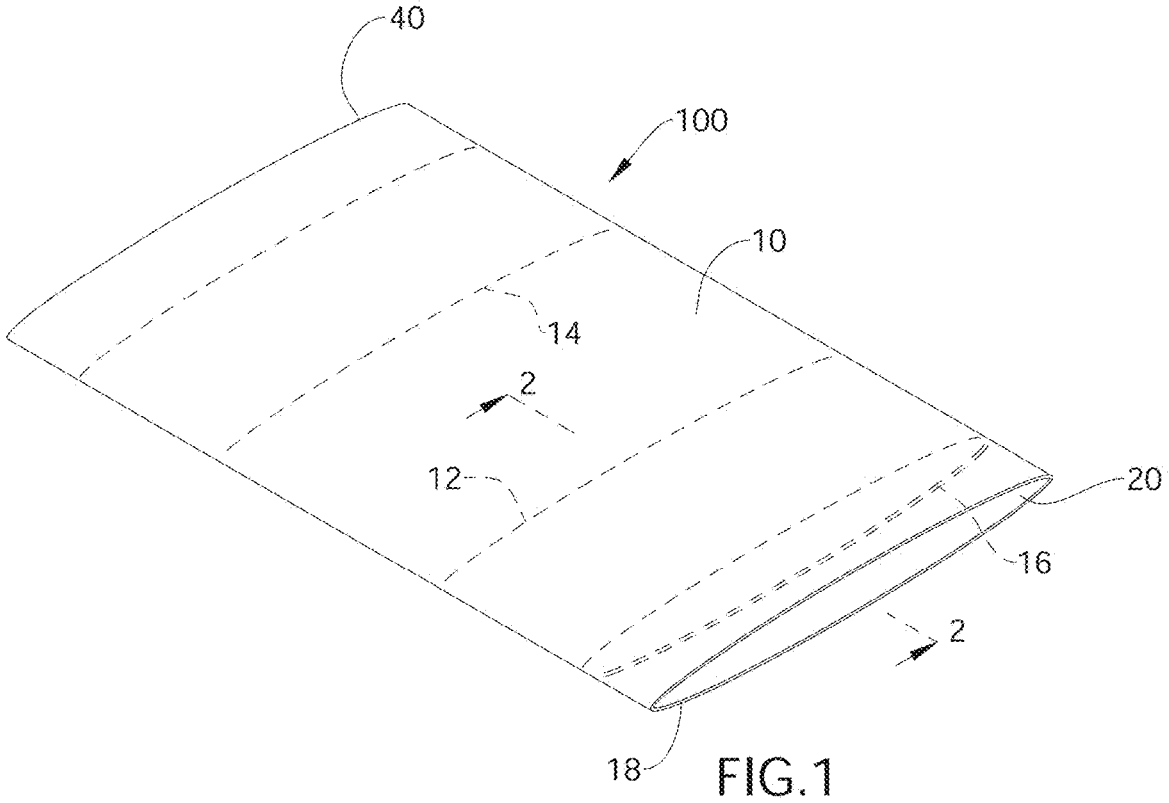
FIG. 1 is a perspective view of an exemplary embodiment of the subject disclosure.
Figure 2:
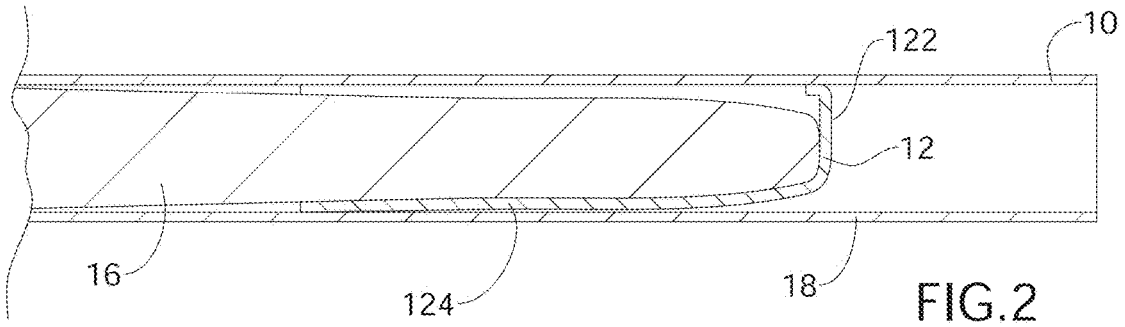
FIG. 2 is a section view of taken along line 2-2 in FIG. 1.
Figure 3:
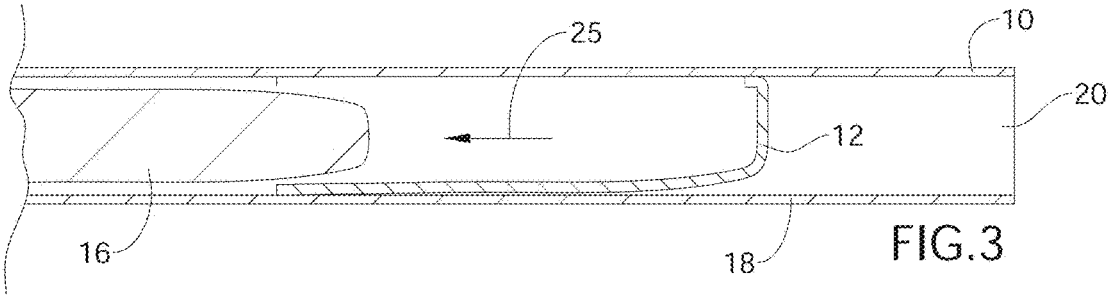
FIG. 3 is a section view of an exemplary embodiment of the subject disclosure, illustrating a pillow 16 being pulled from a first pocket 12.

The following detailed description is of the best currently contemplated modes of carrying out exemplary embodiments of the subject disclosure. The description is not to be taken in a limiting sense but is made merely for the purpose of illustrating the general principles of the subject disclosure, since the scope of the subject disclosure is best defined by the appended claims.

Broadly, an embodiment of the subject disclosure provides a tubular component adapted to receive and secure an object within the lumen of the tubular component, where the object is secured inward of the opposing open ends of the tubular component. For each open end, a pocket component internal to the tubular component is provided where an opening of each pocket component faces toward a midpoint of the tubular component to define face-to-face pocket arrangement of the pockets, wherein this face-to-face pocket arrangement secures the object wholly between the respective pocket components.

Referring to FIGS. 1 through 6, the subject disclosure provides a tubular component 100 with a first end 20 and second end 40 as well as a top surface 10 and bottom surface 18. One or both ends 20, 40 may be open ends of the tubular component 100. Inward of the first end 20 is an inward-facing first pocket component 12. Inward of the second end 40 is an inward-facing second pocket component 14 so that the first pocket component 12 and the second pocket component 14 are spaced apart but facing each other ("face-to-face") within the lumen of the tubular component 100.

The first pocket component 12 has an attached portion 122 and an unattached portion 124. The attached portion 122 has a proximal end, or a portion thereof, that is attached to an inner surface of one of the top or bottom surfaces 10 or 18 to depend therefrom under the force of gravity. The unattached portion 124 is joined to a distal end of the attached portion 122, where in many embodiments the unattached portion 124 is integrated into or is a continuation of the attached portion 122. In some embodiments, the first pocket component 12, attached portion 122 and unattached portion 124 are a unitary element attached to the underside of the top surface 10. In any embodiment, the combination of the attached portion 122 and the unattached portion 124 define a pocket for receiving an end portion of an object 16, such as but not limited to a pillow.

The length of the unattached portion 124 is substantially greater than the length of the attached portion 122 whereby the unattached portion 124 extends along or adjacent to but is not attached to either (top or bottom) surfaces 10, 18 of the tubular component 100.

Figure 4:
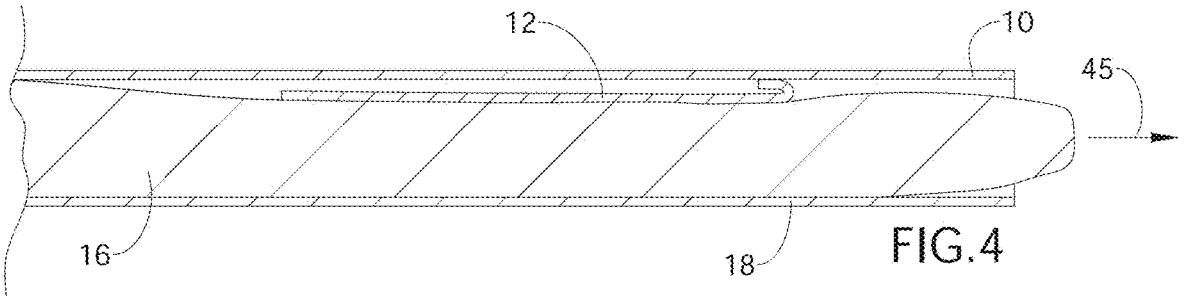
FIG. 4 is a section view of an exemplary embodiment of the subject disclosure, illustrating removal of the pillow 16 from a first end 20 of the tubular component 100 adjacent the first pocket 12.

Because of the unattached portion 124, object 16 may be urged underneath the unattached portion 124 when occupying the lumen. Thus, object 16 can be installed into the first pocket component 12 by first urging the object 16 through the first end 20 and underneath the unattached portion 124 so that the object 16 can be redirected in the outward direction so that an end of the object 16 can be nested in the first pocket portion 12. Likewise, when uninstalling object 16, it can be moved in a first direction 25 before being urged in an opposing second direction 45 out of the first end 20, as illustrated in FIG. 4.

The second pocket component 14 may be (but is not necessarily) a mirror image of the first pocket component 12 about a midline (not shown) of the top/bottom surfaces 10/18 of the tubular component 100 so that their respective openings are face to face.

Figure 5:
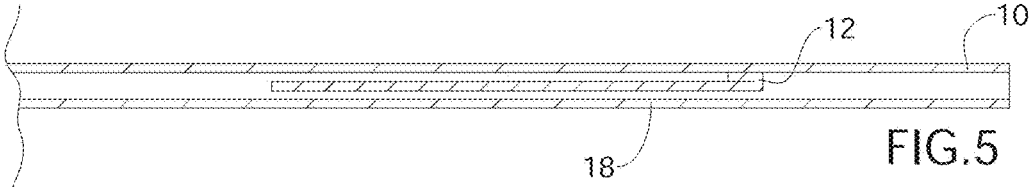
FIG. 5 is a section view of an exemplary embodiment of the subject disclosure, illustrating the tubular component 100 in a flat condition, with the pillow 16 removed.

The material of the pocket components 12 and 14 are sufficiently pliable and flexible so that as the top or bottom surfaces 10 or 18 approach each other, say in an unused condition, the attached portion 122 lays flat there between, thereby facilitating the tubular component 100 moving between a used condition and the unused flat condition. By flat condition, it is understood that the top and bottom surfaces 10 and 18 are sheets of pliable material as are the attached and unattached portions of the pocket components 12, 14, whereby in the flat condition is defined by each said surfaces (10 and 18) and pocket components (12 and 14) being generally planar, as illustrated in FIG. 5, and engaging each other (not shown) so as to lie flat overlapping each other.

The tubular component 100 and first and second pocket components 12 and 14 may be made of material sufficient or effective to retain an object 16 including, but not limited to polymers, rubber, silicone, cloth, fabric (including satin, silk, Egyptian cotton, Viscose, canvas, polyester, nylon, acrylic and vinyl), mesh, and combinations thereof.

Figure 6:
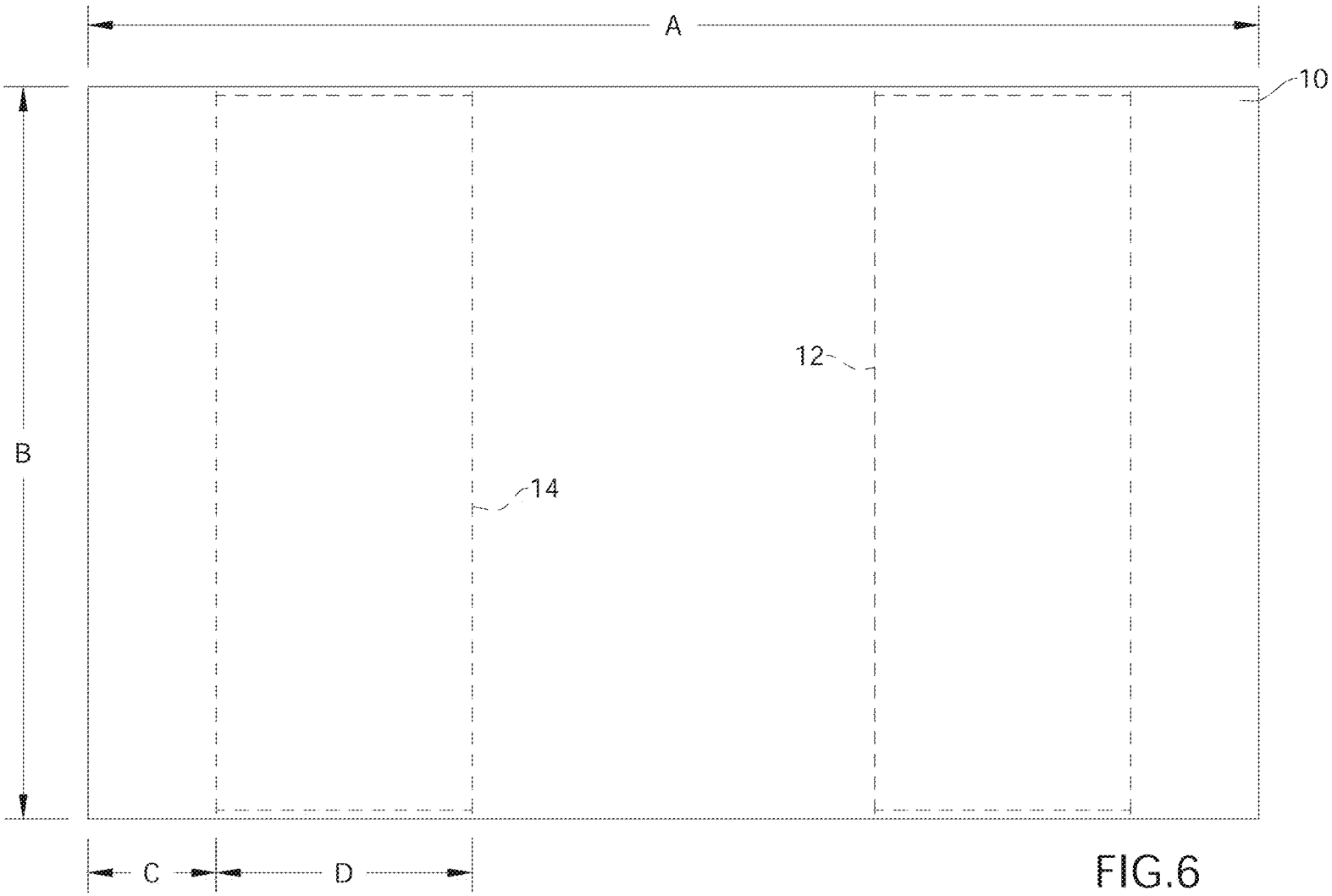
FIG. 6 is a plan view of an exemplary embodiment of the subject disclosure, illustrating the locations of the first pocket component 12 and the second pocket component 14 by way of dashed lines.

Referring to FIG. 6, it is understood that listing the dimensions for all possible embodiments is impractical and so the following dimensional ranges are for some embodiments, while there are possible other embodiments that can have dimensions more or less than the ranges provided immediately below. The (end to end, #20 to #40) length 'A' of the tubular component 100 may range between thirty-two and forty-one inches; the width 'B' may range between twenty and twenty-one inches; the inward offset distance 'C' from one end (20, 40) to the attached portion may range between three and a half to four and a half inches; and a 'length' of the pocket component 'D' (or possibly unattached portion) may be between eight and ten inches. The distance between the opposing attached portion is selected to be sufficient to receive a desired object 16 therebetween.

As used in this application, the term "about" or "approximately" refers to a range of values within plus or minus 10% of the specified number. And the term "substantially" refers to up to 80% or more of an entirety. Recitation of ranges of values herein is not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the subject disclosure and that modifications may be made without departing from the spirit and scope of the subject disclosure as set forth in the following claims.

What is claimed is:

1. A tubular component comprising:

a hollow extending to opposing first and second open ends;

inward each open end, a pocket component fully within the hollow, wherein an opening of the pocket component faces toward a midpoint of the tubular component so that the pocket components of the opposing first and second open ends define a face-to-face pocket arrangement configured to secure an object wholly between the respective pocket components, and wherein each pocket component comprises an attached portion and an unattached portion, and wherein, for each pocket component, the attached portion forms a connection point with an inner surface of the hollow so that a remainder of the attached portion is enabled to extend away from said inner surface while being inward of the respective open end by a non-zero offset distance.

2. The tubular component of claim 1, wherein the unattached portion is not attached to the inner surface of the tubular component.

3. The tubular component of claim 2, wherein each attached portion is attached to a shared side of the inner surface of the tubular component.

4. The tubular component of claim 3, wherein each attached portion defines a boundary that the respective end of the object can occupy during a used condition.

5. The tubular component of claim 4, wherein for each open end, the offset distance between the open end and an entirety of the attached portion is between two and six inches.

6. The tubular component of claim 5, wherein a length each unattached portion extends from a respective attached portion and said midpoint of the tubular component is between eight and ten inches.

7. The tubular component of claim 6, wherein the tubular component is made of material sufficiently pliable to move between the used condition and a flat condition in absence of the object.

8. The tubular component of claim 7, wherein the tubular component is a pillowcase, and wherein the object is a pillow.

* * * * *